United States Patent [19]

Leban

[11] Patent Number: 5,013,524

[45] Date of Patent: May 7, 1991

[54] MARTENSITE-HARDENABLE STEEL

[75] Inventor: Karl Leban, Weiner Neustadt, Austria

[73] Assignee: Boehler Gesellschaft M.B.H., Kapfenberg, Austria

[21] Appl. No.: 513,622

[22] Filed: Apr. 24, 1990

[30] Foreign Application Priority Data

Apr. 24, 1989 [AT] Austria ..... 964/89

[51] Int. Cl.[5] ..... C22C 38/60; C22C 38/08

[52] U.S. Cl. ..... 420/87; 420/92; 420/93; 148/332; 148/328; 148/336

[58] Field of Search ..... 420/87, 93, 92; 148/336, 332, 328

[56] References Cited

FOREIGN PATENT DOCUMENTS 58-123859 7/1983 Japan ..... 420/87

60-59052 4/1985 Japan ..... 420/87

*Primary Examiner*—Deborah Yee

*Attorney, Agent, or Firm*—Fleit, Jacobson, Cohn, Price, Holman & Stern

[57] ABSTRACT

Martensite-hardenable steel, particularly for the production of molds for plastic materials, which consists in weight % of

| | |
|---|---|
| carbon | 0.06–0.2 |
| silicon | 0.15–0.8 |
| manganese | 1.4–3.6 |
| sulfur | 0.12–0.4 |
| chromium | 0–0.9 |
| nickel | 2.8–4.3 |
| vanadium | 0.03–0.15 |
| copper | 0.1–4.0 |
| aluminum | 0.1–4.0 |
| aluminum + copper | 0.9–4.1 |
| niobium | 0.03–0.12 |
| zirconium | 0.01–0.1 |
| calcium | 0–0.01 |
| titanium | 0.01–0.1 |
| molybdenum | 0–1.0 |
| tungsten | 0–1.0 |
| Mo + W/2 | 0–1.5 |
| residue: iron and production impurities. | |

9 Claims, No Drawings

MARTENSITE-HARDENABLE STEEL

BACKGROUND OF THE INVENTION

The invention relates to a martensite-hardenable steel, particularly for the production of molds for plastic, and to the application of said steel.

Martensite-hardenable steels with 18% Ni, 8% Co, 5% Mo, and up to 1% Ti, in which a portion of the nickel content can be replaced by manganese, display a high tensile strength, but are expensive due to the high cobalt and molybdenum contents necessary for precipitation hardening. Steels without cobalt and molybdenum, with a content of 12% Mn, 5% Ni, and 4% Ti, can be precipitation-hardened, to be sure; but martensite formation becomes more difficult for these steels, and as a result they have residual austenite contents that are too high to permit their use as a working material for molding plastic; in addition, their high titanium concentrations result in uneconomically long precipitation periods.

In the production of molds for plastic materials, steel DIN material No. 1,2311 or a variant containing sulfur, DIN material no. 1,2312, are primarily used. These steels can be tempered by the manufacturer to a tensile strength of 900 to at most 1100 N/mm$^2$ and in this condition can be processed into molds or tools, in order to avoid dimensional or surface irregularities during heat treatment of finish-coated tools.

Here the strength of the material is limited due to the increasingly difficult workability of the material; in addition, a high degree of tool wear arises in the machining of unfinished bodies with high strengths, e.g. 1050 N/mm$^2$.

The problem, therefore, is to provide a steel which is particularly suited for the production of molds for plastic materials and which, in tempered condition, displays a strength of at least 1050 N/mm$^2$ and a hardness of at least 38 HRC, with improved isotropy of the mechanical values, and which can be easily machined, is easily workable and polishable, and which can be employed in this condition without secondary thermal treatment. As a solution to this problem the invention provides a steel with a composition described below.

Conventional martensite-hardenable steels are of only limited attractiveness due to their high alloy contents and the associated costs, as well as due to their laborious production technology in the case of molds for plastic materials and/or due to poor machinability and high tool wear.

BRIEF SUMMARY OF THE INVENTION

The inventive steel or, as the case may be, the steel to be employed according to the invention, is an iron-based alloy with the components described below. The alloying elements in appropriate concentrations are included with a view to their synergistic effect and in order to afford good workability with slight tool wear, even in a hardened condition displaying high tensile strength and hardness of material—as well as to improve the isotropy of the mechanical values, polishability and achievable surface quality, and the molding time. At the same it is possible to produce large molds, since no secondary heat treatment of the working mold, with the consequent risk of distortion, is necessary.

DETAILED DESCRIPTION

Important to the inventive alloy wherein the amounts of the ingredients are expressed in % by weight, is a carbon content in the area of at least 0.06% and at most 0.2%, preferably 0.08% to 0.18%, particularly 0.1% to 0.15%, the purpose of which is to achieve the necessary matrix strength and hardness. Contents lower than 0.06% reduce the achievable strength; contents above 0.2% result in the embrittlement of the material.

Silicon contents below 0.15% lead to a poor degree of purity and those above 0.8% to a reduction in material toughness, despite increased hardness. Manganese has an austenite-stabilizing effect, particularly in forming sulfide, so that with the appropriate manganese and sulfur concentrations the machining properties of the material can be improved through inclusion of sulfide. Given sulfur contents of 0.12% to 0.4% the correct manganese concentration is 1.4% to 3.6% for sulfide precipitation of the appropriate form and the desired degree of austenite stabilization; the most favorable values were found to be 0.15 to 0.25% sulfur and 1.8% to 2.2% manganese. After hot-forming, sulfides or sulfide ingredients can result in a banding structure of the material and in anisotropy of the mechanical properties and can also cause crater wear of the tool during machining. In the case of zirconium and titanium contents of 0.01 to 0.1%, preferably 0.02 to 0.06%, particularly 0.03 to 0.05%, the sulfide morphology is favorably affected, so that along with improved machining properties an increased isotropy of the mechanical properties and a reduction of tool wear during dressing is achieved. Calcium contents up to 0.01%, particularly in the range from 0.002 to 0.006% result in the formation of alum earth spinel ingredients and a favorable sulfide morphology in the inventive melt. By modifying the ingredients in this fashion the isotropy of the mechanical properties and the workability of the material is further improved; in particular there is a large reduction in wear, or increase in operating life, of the cutting tools. Vanadium contents of 0.03 to 0.15%, particularly 0.05 to 0.1%, confer an increase in secondary hardness and a granular refinement and the related high material toughness. Niobium behaves similar to vanadium, though the granular refining effect is more pronounced due to the high carbon activity of the niobium; concentrations of 0.03 to 0.12% confer improved results and contents of 0.05 to 0.08% confer the most favorable results. The inventive steel is also alloyed with carbon, manganese, nickel, copper, and aluminum, which elements become dissolved in the austenite upon heating to a temperature of more than 800° C. and can be kept in solution by rapid cooling to room temperature. Reheating or precipitation at temperatures around 500° C. results in precipitation of the alloying elements from the martensite, or to formation of intermetallic phases or compounds which bring about an increase in the hardness of the material. With manganese contents from 1.4 to 3.6% and nickel contents of 2.8 to 4.3%, copper concentrations of 0.1 to 4.0% and aluminum concentrations of 0.1 to 4.0% have the effect of increasing strength and hardness. However, in achieving the desired increase in hardness and strength to 38 HRC, particularly 40 HRC, or at least 1100 N/mm$^2$, particularly 1200 N/mm$^2$, while avoiding an undesirable loss of toughness in the material, contents of copper+aluminum of 0.9 to 4.1% are provided. The best results for the inventive alloy were found with contents of 1.8 to 2 2% manganese, 3.4 to 3.6% nickel, 0.4 to 2.4% copper, 0.1 to 2.1% aluminum, when the value of copper and aluminum was between 1.5 and 2.5%. As the element inhibiting austenite formation, chromium should not exceed a concentration of 0.9%, preferably 0.5%, since higher contents will negatively affect the precipitation process of the inventive alloys. Molybdenum and tungsten, particularly in combination, also have unfavorable effects with concentrations exceeding 1.0% and 1.5%, although higher contents of these elements are often necessary in conventional martensite-hardenable steels as components increasing strength and hardness.

The invention is described in greater detail below on the basis of embodiments in Examples 1, 2 and 3 of alloys A, B and C respectively.

EXAMPLE 1

A steel A with the composition indicated in Table 1, in wt/% was precipitation-hardened to a strength of 1271 N/mm$^2$ and a hardness of 40 HRC. Cutting treatment was performed on a lathe (dry cut) with the following parameters:

cutting material: WSP SB20 SPUN 12 03 08
cutting speed: V=180 m/min
depth of cut: a=2.0 mm
forward feed: s=0.224 mm/r After a cutting time of 20 minutes the tool showed a width of wear indication of VB=0.15 mm. In the same test with the same parameters, steels according to DIN material no. 1,2311 and material no. 1,2312, with a strength of 1250 N/mm$^2$, were machined, resulting in a width of wear indication for the tools of 0.26 mm and 0.24 mm. As compared with material no. 1,2312 the values obtained for alloy A were considerably better in the tests for mechanical properties and achieved surface quality after polishing.

EXAMPLE 2

A steel B with the alloy concentrations given in Table 1 was precipitation-hardened to a strength of 1264 N/mm$^2$ and a hardness of more than 40 HRC. Again, in comparison with steels according to material no. 1,2311 and material no. 1,2312, samples were cut with hard-metal tipped fly-mill cutters under the following conditions:

cutting speed: V=118 m/min
forward feed: s=0.24 mm/tooth
depth of cut: a=2.0 mm

The width of wear indication V of the tools in the case of a machined volume of 350 cm was 0.23 mm for steel B, 0.35 mm for material no. 1,2311, and 0.33 mm for material no. 1,2312.

EXAMPLE 3

Comparative testing employing deep-hole drilling was performed with hard-metal tipped single-lip drills (diameter 10 mm) on a steel C, indicated in Table 1, with a strength of 1280 N/mm$^2$ (40.5 HRC), and on materials no. 1,2311 and no. 1,2312, with strengths of 1040 and 1080 N/mm$^2$. The cutting speed was 48 m/min and the forward feed S=0.125 mm/r. The drilling capacity or drill path was 3171 mm for steel C, as compared to 2018 mm for material no. 1,2311 and 2163 mm for material no. 1,2312—which represents an increased drilling capacity of about 47% for the inventive steel C.

TABLE

| | Alloying Elements By Weight Percent | | | | | | | | | | | | | |
|---|---|---|---|---|---|---|---|---|---|---|---|---|---|---|
| Steel Alloy | C | Mn | S | Cr | Ni | V | Nb | Cu | Al | Zr | Ti | Co | Si | Mo |
| A | 0.14 | 2,19 | o,25 | o,22 | 3,52 | 0,09 | 0,06 | 2,05 | 0,42 | 0,03 | 0,04 | 0,003 | 0,63 | 0,08 |
| B | 0,11 | 1,97 | 0,18 | 0,51 | 3,43 | 0,1 | 0,04 | 1,23 | 1,o3 | 0,07 | 0,03 | — | 0.28 | 0,40 |
| C | 0.08 | 1,62 | 0,16 | 0,43 | 3,69 | 0.07 | 0.08 | 0.79 | 1,34 | 0,04 | 0.06 | 0.005 | 0.31 | — |
| DIN Material Nr.1.2311 | 0.41 | 1,45 | 0,008 | 1,92 | 0,63 | — | — | 0,18 | 0,001 | — | — | — | 0.32 | 0,23 |
| DIN Material Nr.1.2312 | 0,39 | 1,52 | 0,09 | 1.87 | 0.28 | — | — | 0,21 | 0,002 | — | — | — | 0,28 | 0.19 |

I claim:

1. Martensite-hardenable steel for the production of molds for plastic comprising in weight %:

| | |
|---|---|
| carbon | 0.06–0.2 |
| silicon | 0.15–0.8 |
| manganese | 1.4–3.6 |
| sulfur | 0.12–0.4 |
| chromium | 0–0.9 |
| nickel | 2.8–4.3 |
| vanadium | 0.03–0.15 |
| copper | 0.1–4.0 |
| aluminum | 0.1–4.0 |
| aluminum + copper | 0.9–4.1 |
| niobium | 0.03–0.12 |
| zirconium | 0.01–0.1 |
| calcium | 0–0.01 |
| titanium | 0.01–0.1 |
| molybdenum | 0–1.0 |
| tungsten | 0–1.0 |
| MO + W/2 | 0–1.5 |
| residue: iron and production impurities. | |

2. Martensite-hardenable steel as claimed in claim 1, comprising in weight %:

| | |
|---|---|
| carbon | 0.08–0.18 |
| silicon | 0.25–0.40 |
| manganese | 1.6–2.8 |
| sulfur | 0.15–0.3 |
| chromium | 0–0.5 |
| nickel | 3.3–3.7 |
| vanadium | 0.05–0.1 |
| copper | 0.3–3.0 |
| aluminum | 0.1–2.8 |
| aluminum + copper | 1.0–3.1 |
| niobium | 0.04–0.06 |
| zirconium | 0.02–0.06 |
| titanium | 0.02–0.06 |
| calcium | 0–0.008 |
| molybdenum | 0–0.8 |
| tungsten | 0–0.8 |
| Mo + W/2 | 0–1.0 |
| residue: iron and production impurities. | |

3. Martensite-hardenable steel as claimed in claim 1, comprising in weight %:

| | |
|---|---|
| carbon | 0.10–0.15 |
| silicon | 0.25–0.35 |
| manganese | 1.8–2.2 |

-continued

| | |
|---|---|
| sulfur | 0.15–0.25 |
| chromium | 0–0.5 |
| nickel | 3.4–3.6 |
| vanadium | 0.05–0.1 |
| copper | 0.4–2.4 |
| aluminum | 0.1–2.1 |
| aluminum + copper | 1.5–2.5 |
| niobium | 0.05–0.08 |
| zirconium | 0.03–0.05 |
| titanium | 0.03–0.05 |
| calcium | 0.002–0.006 |
| molybdenum | 0–0.8 |
| tungsten | 0.08 |
| Mo + W/2 | 0–1.0 |
| residue: iron and production impurities. | |

4. Martensite and precipitation hardened steel, for the production of molds for plastic, comprising in weight %:

| |
|---|
| 0.12–0.4, sulfur, |
| 0.01–0.1, zirconium, |
| 0.01–0.1, titanium, |
| 0.001–0.01 calcium, |
| residue: iron and production impurities |

5. A mold for molding plastic products wherein the mold is made from a steel alloy comprising in weight %:

| | |
|---|---|
| carbon | 0.06–0.2 |
| silicon | 0.15–0.8 |
| manganese | 1.4–3.6 |
| sulfur | 0.12–0.4 |
| chromium | 0–0.9 |
| nickel | 2.8–4.3 |
| vanadium | 0.03–0.15 |
| copper | 0.1–4.0 |
| aluminum | 0.1–4.0 |
| aluminum + copper | 0.9–4.1 |
| niobium | 0.03–0.12 |
| zirconium | 0.01–0.1 |
| calcium | 0–0.01 |
| titanium | 0.01–0.1 |
| molybdenum | 0–1.0 |
| tungsten | 0–1.0 |
| Mo + W/2 | 0–1.5 |
| residue: iron and production impurities. | |

6. A mold for molding plastic products wherein the mold is made from a steel alloy comprising in weight %:

| | |
|---|---|
| carbon | 0.08–0.18 |
| silicon | 0.25–0.40 |
| manganese | 1.6–2.8 |
| sulfur | 0.15–0.3 |

-continued

| | |
|---|---|
| chromium | 0–0.5 |
| nickel | 3.3–3.7 |
| vanadium | 0.05–0.1 |
| copper | 0.3–3.0 |
| aluminum | 0.1–2.8 |
| aluminum + copper | 1.0–3.1 |
| niobium | 0.04–0.06 |
| zirconium | 0.02–0.06 |
| titanium | 0.02–0.06 |
| calcium | 0–0.008 |
| molybdenum | 0–0.8 |
| tungsten | 0–0.8 |
| Mo + W/2 | 0–1.0 |
| residue: iron and production impurities. | |

7. A mold for molding plastic products wherein the mold is made from a steel alloy comprising in weight %:

| | |
|---|---|
| carbon | 0.10–0.15 |
| silicon | 0.25–0.35 |
| manganese | 1.8–2.2 |
| sulfur | 0.15–0.25 |
| chromium | 0–0.5 |
| nickel | 3.4–3.6 |
| vanadium | 0.05–0.1 |
| copper | 0.4–2.4 |
| aluminum | 0.1–2.1 |
| aluminum + copper | 1.5–2.5 |
| niobium | 0.05–0.08 |
| zirconium | 0.03–0.05 |
| titanium | 0.03–0.05 |
| calcium | 0.002–0.006 |
| molybdenum | 0–0.8 |
| tungsten | 0–0.08 |
| Mo + W/2 | 0–1.0 |
| residue: iron and production impurities. | |

8. Martensite and precipitation hardened steel as claimed in claim 4 wherein said elements comprise in weight %:

| | |
|---|---|
| 0.15–0.30 | sulfur, |
| 0.02–0.06 | zirconium, |
| 0.02–0.06 | titanium, |
| 0.001–0.01 | calcium, |
| residue: iron and production impurities. | |

9. Martensite and precipitation hardened steel as claimed in claim 4 wherein said elements comprise in weight %:

| |
|---|
| 0.15–0.25 sulfur, |
| 0.01–0.1, 0.05–0.08 zirconium, |
| 0.01–0.1, 0.05–0.08 titanium, |
| 0.001–0.01 calcium, |
| residue: iron and production impurities. |

* * * * *